US006836965B1

(12) United States Patent
Ross

(10) Patent No.: US 6,836,965 B1
(45) Date of Patent: Jan. 4, 2005

(54) ROTATIONAL HAIR CUTTING DEVICE

(76) Inventor: Alrita Ross, 1359 N. Chaffrey Ct., Ontario, CA (US) 91762

( * ) Notice: Subject to any disclaimer, the term of this patent is extended or adjusted under 35 U.S.C. 154(b) by 6 days.

(21) Appl. No.: 10/389,201

(22) Filed: Mar. 14, 2003

(51) Int. Cl.[7] ..... B26B 19/00
(52) U.S. Cl. ..... 30/29.5; 30/43.6
(58) Field of Search ..... 30/29.5, 43.4, 30/43.5, 43.6, 346.51

(56) References Cited

U.S. PATENT DOCUMENTS

| | | | | | |
|---|---|---|---|---|---|
| 15,630 | A | | 8/1856 | Ward | |
| 3,284,894 | A | * | 11/1966 | Ryan | 30/29.5 |
| 3,381,373 | A | * | 5/1968 | Brown | 30/29.5 |
| 3,524,253 | A | * | 8/1970 | Hoke | 30/29.5 |
| 3,699,652 | A | * | 10/1972 | Deverman et al. | 30/29.5 |
| 3,731,379 | A | * | 5/1973 | Williams | 30/29.5 |
| 3,925,888 | A | * | 12/1975 | Bozsanyi | 30/29.5 |
| 3,965,569 | A | * | 6/1976 | Bolduc | 30/29.5 |
| 4,958,432 | A | * | 9/1990 | Marshall | 30/29.5 |
| 4,977,672 | A | | 12/1990 | Hamilton | |
| 5,012,576 | A | * | 5/1991 | Johannesson | 30/29.5 |
| 5,365,952 | A | | 11/1994 | Noble et al. | |
| 5,699,616 | A | | 12/1997 | Ogawa | |
| 5,884,401 | A | * | 3/1999 | Eckardt | 30/44 |
| 6,711,822 | B1 | * | 3/2004 | Ginns | 30/206 |

* cited by examiner

*Primary Examiner*—Hwei-Siu Payer

(57) ABSTRACT

A rotational hair cutting device for providing a hair cutter with interchangeable blades that are designed for cutting detailed patterns on short hair using a rotational action includes a housing, an axle positioned in the housing, a rotational means for rotating the axle, a blade member having a cutting surface, a connector such as a chuck for coupling the blade member to the axle such that the blade member is rotated to rotate the cutting surface around a longitudinal axis of the blade member, and a cover screen coupled to the blade member.

14 Claims, 3 Drawing Sheets

ROTATIONAL HAIR CUTTING DEVICE

BACKGROUND OF THE INVENTION

1. Field of the Invention

The present invention relates to hair cutters and more particularly pertains to a new rotational hair cutting device for providing a hair cutter with interchangeable blades that are designed for cutting detailed patterns on short hair using a rotational action.

2. Description of the Prior Art

The use of hair cutters is known in the prior art. U.S. Pat. No. 5,699,616 describes a hair cutting device having a first blade that moves in a reciprocating motion relative to a fixed blade. Another type of hair cutting device for cutting a pattern is U.S. Pat. No. 4,977,672 disclosing a template to guide hair cutting to form a pattern. U.S. Pat. No. 5,365,952 discloses a dual comb structure for lifting hair to be cut.

While these devices fulfill their respective, particular objectives and requirements, none provide a rotational cutting blade suitable for cutting in close proximity to the body as in the present invention.

SUMMARY OF THE INVENTION

The present invention meets the needs presented above by providing interchangeable rotating cutting blades and a cover screen that permits safe positioning of the cutting blade in close proximity to the body to cut a pattern into hair.

Still yet another object of the present invention is to provide a new rotational hair cutting device that safely permits positioning of rotating blades in close proximity to the body.

Even still another object of the present invention is to provide a new rotational hair cutting device that provides various shapes of cutting blades to permit greater flexibility in creating and achieving desired patterns in hair.

To this end, the present invention generally comprises interchangeable rotating blades each covered by a cover screen to protect the body during cutting of hair in close proximity to the body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
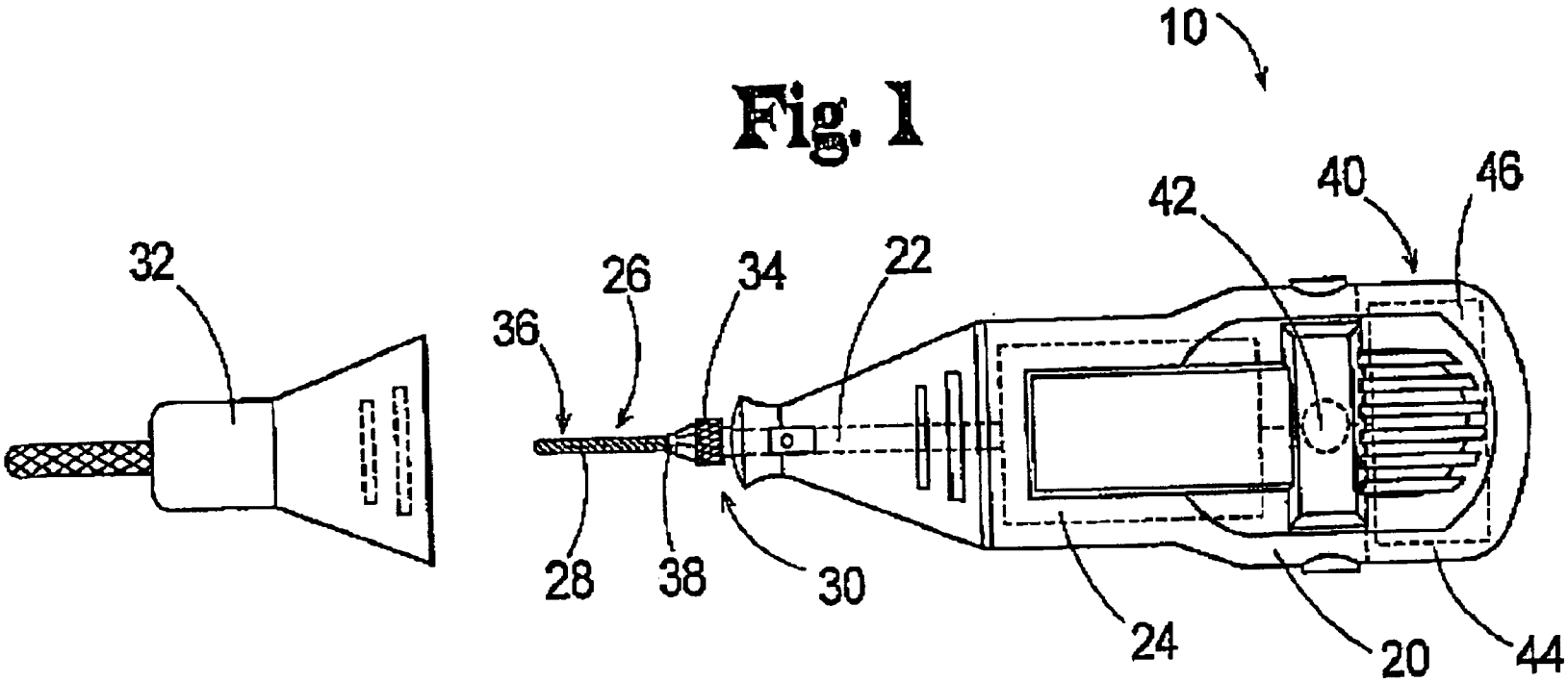
FIG. 1 is a side view of a new rotational hair cutting device according to the present invention.
Figure 2:
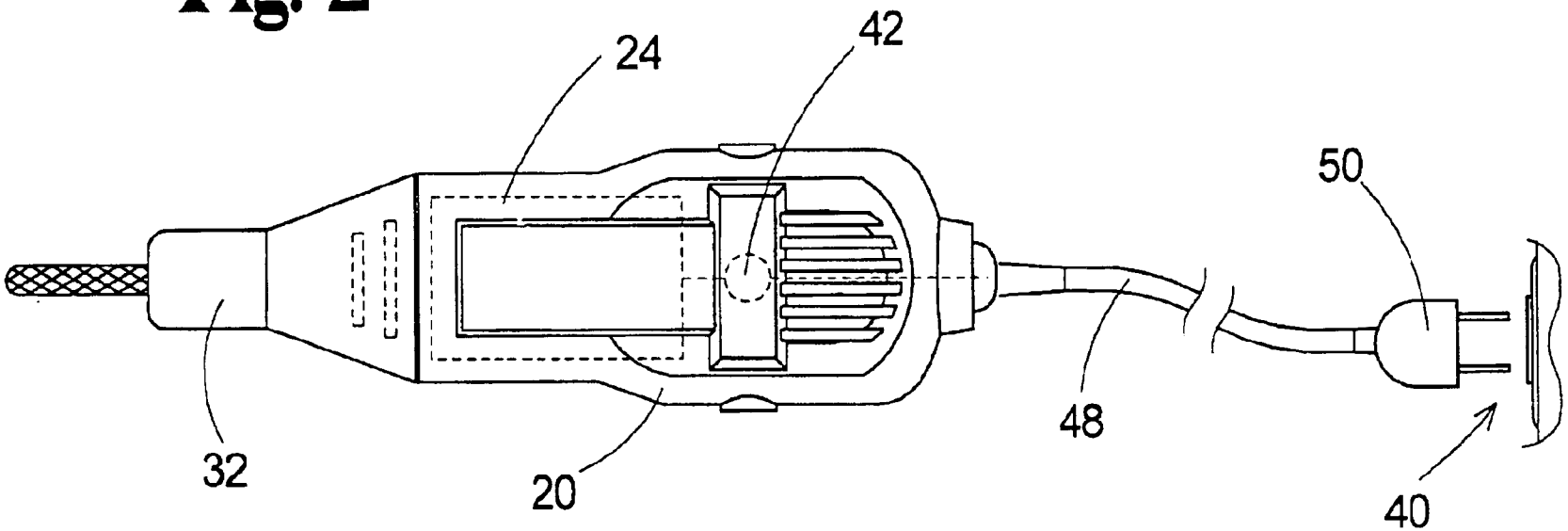
FIG. 2 is a side view of an alternately powered embodiment of the present invention.
Figure 3:
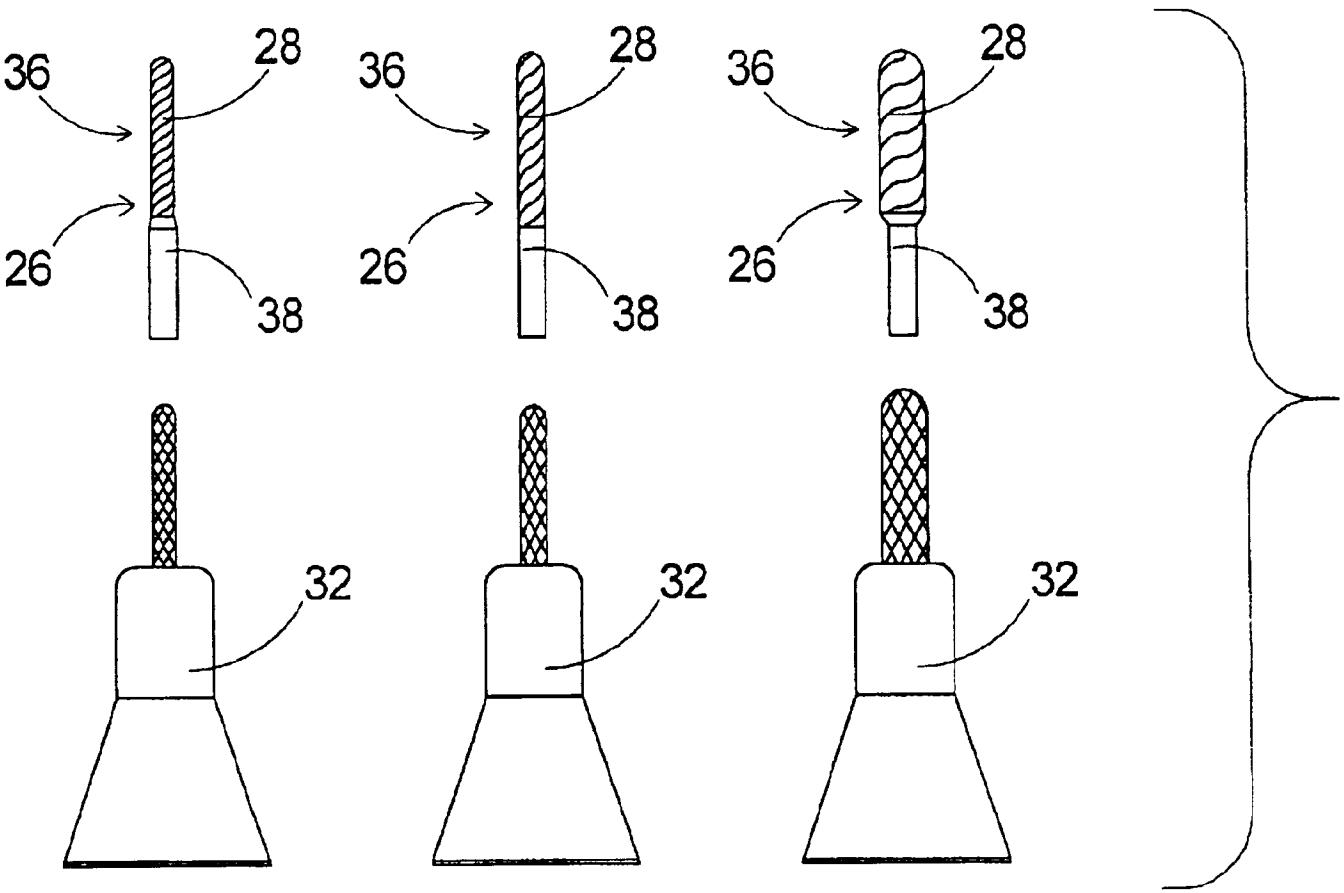
FIG. 3 is a front view of various blade members and corresponding cover screens of the present invention.

With reference now to the drawings, and in particular to FIGS. 1 through 3 thereof, a new rotational hair cutting device embodying the principles and concepts of the present invention will be described.

As best illustrated in FIGS. 1 through 3, the rotational hair cutting device generally comprises a housing 20, an axle 22 positioned in the housing 20, a rotational means 24 for rotating the axle 22, a blade member 26 having a cutting surface 28, a connection means 30 for coupling the blade member 26 to the axle 22 such that the blade member 26 is rotated to rotate the cutting surface 28 around a longitudinal axis of the blade member 26, and a cover screen 32 coupled to the blade member 26.

The cover screen 32 forms a mesh designed for receiving hairs therethrough when the cover screen 32 is positioned in close proximity to a body from which hairs emanate. The cover screen 32 is positioned in close proximity to a portion of the cutting surface 28. Thus, the cutting surface 28 cuts hairs extending through the cover screen 32 when the blade member 26 is rotated.

In an embodiment, the blade member 26 is one of a plurality of interchangeable blade members. Each of the plurality of blade members 26 includes a unique width relative to each other blade member 26 for facilitating cutting of hair in lines having various selectable widths. Thus, various designs can more easily be cut into the hair including emblems and writing. The plurality of blade members includes blade members having respective widths of 1/16 inches, 1/8 inches, and 1/4 inches.

In an embodiment, the cover screen 32 is one of a plurality of cover screens. Each cover screen 32 is coupled to an associated one of the blade members 26. Each cover screen 32 is shaped complimentary to the blade member 26 for substantially enclosing the blade member 26. Each cover screen 32 is also removable from the blade member 26 to facilitate cleaning of the cover screen 32 and the blade member 26. The cover screen may be attached directly to the housing using known methods and structures to prevent rotation of the cover screen during use or may include a neck portion that attaches around the blade member while permitting free rotation of the blade member relative to the cover screen. It is important that the blade member be covered by the cover screen along a substantial portion of the blade member to permit safe positioning of the device against a body but the cover member may have a slot through which the blade member can be removed, a panel may be removable from the cover screen to permit removal of the blade member, or any other currently known structure may be employed to permit separation of the cover screen and the blade member.

The connection means 30 is preferably a chuck assembly 34 coupled to the axle 22. Each blade member 26 includes a cutting portion 36 and a post portion 38. The post portion is insertable into the chuck assembly 34 for securing the post portion 38 to the chuck assembly 34 in the same manner that a drill bit is typically connected to a drill.

The housing 20 is elongated and generally cylindrical having a length of approximately 7 inches and a width of approximately 1 ½ inches to permit easy manipulation of the device and comfortable grasping of the device during use.

A power source 40 is operationally coupled to the rotational means 24 for providing power to the rotational means 24. Typically, the rotational means 24 is a motor run by electric power. A power switch 42 is coupled to the housing. The power switch 42 is coupled between the power source 40 and the rotational means 24. The power switch 42 is positioned to be accessible to a user for selectively preventing the rotational means 24 from rotating the axle 22.

The power source may be self contained or provided from an outside source. In one embodiment, the housing 20 includes a battery compartment 44. A battery 46 is positioned in the battery compartment 44 for providing power to the rotational means 24. In a second embodiment, a power cord 48 is coupled to the rotational means 24. The power cord 48 includes a plug portion 50 for coupling to a power outlet 40 whereby the power cord 48 supplies power to the rotational means 24. It is further contemplated that similar to electronic devices such as portable audio players, the device may combine the potential power sources by having both a power cord and a battery compartment with the battery being used only when the power cord is not being used to provide power.

The device is further provided as part of a kit including the device, multiple blade members, a comb, a cleaning brush, and materials such as pens or cutting devices to facilitate the creation of templates or samples of the designs to be cut into the hair.

In use, the desired size of blade member is selected and secured to the axle using the connection means. The cover screen is positioned over the blade member. The device is turned on to cause the blade member to rotate. The cover screen is then positioned against the body of a person to permit hairs of the person to extend through the cover screen where they are cut by the rotating blade surface. The device is then moved along a desired path on the body to create the desired pattern. Blade sizes may be changed as desired to create patterns or designs with lines of various thickness.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotational hair cutting device comprising:

a housing;

an axle positioned in said housing;

a rotational means for rotating said axle;

a blade member having a cutting surface;

a connection means for coupling said blade member to said axle such that said blade member is rotated to rotate said cutting surface around a longitudinal axis of said blade member;

a cover screen positioned to cover said blade member, said cover screen forming a mesh adapted for receiving hairs therethrough when said cover screen is positioned in close proximity to a body from which hairs emanate, said cover screen being positioned in close proximity to a portion of said cutting surface whereby said cutting surface cuts hairs extending through said cover screen when said blade member is rotated;

said blade member being one of a plurality of interchangeable blade members;

each of said plurality of blade members having a unique width relative to each other blade member for facilitating cutting of hair in lines having various selectable widths;

said cover screen being one of a plurality of cover screens, each cover screen being positionable to cover an associated one of said blade members;

wherein each said cover screen is shaped complimentary to an associated one of said blade members for substantially enclosing said associated blade member;

wherein said cover screen is removable from being positioned to cover said blade member to facilitate cleaning of said cover screen and said blade member;

said connection means being a chuck assembly coupled to said axle;

wherein said blade member includes a cutting portion and a post portion, said post portion being insertable into said chuck assembly for securing said post portion to said chuck assembly;

wherein said housing is elongated and generally cylindrical;

a power source operationally coupled to said rotational means for providing power to said rotational means;

a power switch coupled to said housing, said power switch being coupled between said power source and said rotational means, said power switch being accessible to a user for selectively preventing said rotational means from rotating said axle; and wherein said plurality of blade members includes blade members having respective widths of 1/16 inches, 1/18 inches, and 1/4 inches.

2. The rotational hair cutting device of claim 1, further comprising:

said housing including a battery compartment; and a battery positioned in said battery compartment for providing power to said rotational means.

3. The rotational hair cutting device of claim 1, further comprising:

a power cord coupled to said rotational means, said power cord including a plug portion for coupling to a power outlet whereby said power cord supplies power to said rotational means.

4. A rotational hair cutting device comprising:

a housing;

an axle positioned in said housing;

a rotational means for rotating said axle;

a blade member having a cutting surface;

a connection means for coupling said blade member to said axle such that said blade member is rotated to rotate said cutting surface around a longitudinal axis of said blade member;

a cover screen positioned to cover said blade member, said cover screen forming a mesh adapted for receiving hairs therethrough when said cover-screen is positioned in close proximity to a body from which hairs emanate, said cover screen being positioned in close proximity to a portion of said cutting surface whereby said cutting surface cuts hairs extending through said cover screen when said blade member is rotated;

said connection means being a chuck assembly coupled to said axle; and wherein said blade member includes a cutting portion and a post portion, said post portion being insertable into said chuck assembly for securing said post portion to said chuck assembly.

5. The rotational hair cutting device of claim 4, further comprising:

said blade member being one of a plurality of interchangeable blade members.

6. The rotational hair cutting device of claim 5, further comprising:

each of said plurality of blade members having a unique width relative to each other blade member for facilitating cutting of hair in lines having various selectable widths.

7. The rotational hair cutting device of claim 6 wherein said plurality of blade members includes blade members having respective widths of 1/16 inches, 1/8 inches, and 1/4 inches.

8. The rotational hair cutting device of claim 5, further comprising:

said cover screen being one of a plurality of cover screens, each cover screen being positionable to cover an associated one of said blade members.

9. The rotational hair cutting device of claim 4 wherein said cover screen is shaped complimentary to said blade member for substantially enclosing said blade member.

10. The rotational hair cutting device of claim 4 wherein said cover screen is removable from close positioning to said blade member to facilitate cleaning of said cover screen and said blade member.

11. The rotational hair cutting device of claim 4, wherein said housing is elongated and generally cylindrical.

12. The rotational hair cutting device of claim 4, further comprising:

said housing including a battery compartment; and a battery positioned in said battery compartment for providing power to said rotational means.

13. The rotational hair cutting device of claim 4, further comprising:

a power cord coupled to said rotational means, said power cord including a plug portion for coupling to a power outlet whereby said power cord supplies power to said rotational means.

14. The rotational hair cutting device of claim 4, further comprising:

a power source operationally coupled to said rotational means for providing power to said rotational means; and a power switch coupled to said housing, said power switch being coupled between said power source and said rotational means, said power switch being accessible to a user for selectively preventing said rotational means from rotating said axle.

* * * * *